US012434931B2

(12) United States Patent
Tsuchihashi

(10) Patent No.: US 12,434,931 B2
(45) Date of Patent: Oct. 7, 2025

(54) PAPER SHEET PROCESSING APPARATUS

(71) Applicant: TOSHIBA TEC KABUSHIKI KAISHA, Tokyo (JP)

(72) Inventor: Hiroyuki Tsuchihashi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 251 days.

(21) Appl. No.: 18/173,813

(22) Filed: Feb. 24, 2023

(65) Prior Publication Data

US 2024/0286856 A1 Aug. 29, 2024

(51) Int. Cl.

| | |
|---|---|
| ***B65H 37/04*** | (2006.01) |
| ***B65H 7/08*** | (2006.01) |
| ***B65H 9/10*** | (2006.01) |

(52) U.S. Cl.

CPC ..... *B65H 7/08* (2013.01); *B65H 9/10* (2013.01); *B65H 37/04* (2013.01); *B65H 2511/21* (2013.01); *B65H 2513/11* (2013.01); *B65H 2801/06* (2013.01); *B65H 2801/27* (2013.01)

(58) Field of Classification Search

CPC ..... B65H 9/106; B65H 37/04; B65H 2553/22

See application file for complete search history.

(56) References Cited

U.S. PATENT DOCUMENTS

| | | | | |
|---|---|---|---|---|
| 7,748,704 | B2 * | 7/2010 | Terao | B65H 31/26 270/58.11 |
| 8,794,617 | B2 | 8/2014 | Tokuma | |
| 9,914,611 | B2 | 3/2018 | Tokuma | |
| 10,182,829 | B2 | 1/2019 | Tokuma | |
| 10,882,710 | B2 * | 1/2021 | Taki | B65H 29/34 |
| 2018/0312361 | A1 * | 11/2018 | Iwamoto | G03G 15/6576 |

FOREIGN PATENT DOCUMENTS

| | | |
|---|---|---|
| JP | 2010-195523 | 9/2010 |

* cited by examiner

*Primary Examiner* — Howard J Sanders
(74) *Attorney, Agent, or Firm* — Amin, Turocy & Watson, LLP

(57) ABSTRACT

A paper sheet processing apparatus includes a processing tray, a feed member, a drive unit, a detection unit, and a control unit. The processing tray receives and stacks a plurality of paper sheets. The feed member faces the processing tray and includes a paddle that is elastically deformed by being pressed against the paper sheets during rotation. The drive unit rotates the feed member. The detection unit detects a leading end of the paper sheet being fed toward the alignment surface by the paddle. The control unit controls the drive unit based on a detection result during a period from if the detection unit detects the leading end of the paper sheet to if the paddle separates from the paper sheet and controls the rotation of the feed member so that the leading end of the paper sheet scraped by the paddle is aligned with the alignment surface.

16 Claims, 8 Drawing Sheets

PAPER SHEET PROCESSING APPARATUS

FIELD

Embodiments described herein relate generally to, for example, a paper sheet processing apparatus that stacks and aligns a plurality of paper sheets, an image forming apparatus and methods related thereto.

BACKGROUND

As a multifunction peripheral having copy function, print function, scan function, and the like, for example, one equipped with a finisher that stacks and binds a predetermined number of sheets after image formation is known. A finisher includes a standby tray, a processing tray, and a stapler.

While the predetermined number of sheets stacked on the processing tray are aligned and stapled, the standby tray causes the next two or three sheets to be stapled to wait above the processing tray. There is a feed member with a paddle between the standby tray and the processing tray. The feed member rotates while the paddle contacts the upper surface of the paper falling from the standby tray to the processing tray, scrapes the paper toward the alignment surface of the stopper at one end of the processing tray, and aligns the edges of the paper against the alignment surface.

If the paper stacked in the standby tray is dropped into the processing tray, the stacking posture of the paper tends to be disturbed. In addition, the stacking posture of the paper on the processing tray tends to vary depending on the paper size, weight, thickness, material, and presence or absence of curls and wrinkles. Therefore, even if the feed member is rotated and an attempt is made to align the edges of the paper against the alignment surface, the edges of the paper may not reach the alignment surface or bounce off the alignment surface and the edges of the paper tend to be unaligned.

DETAILED DESCRIPTION

Figure 1:
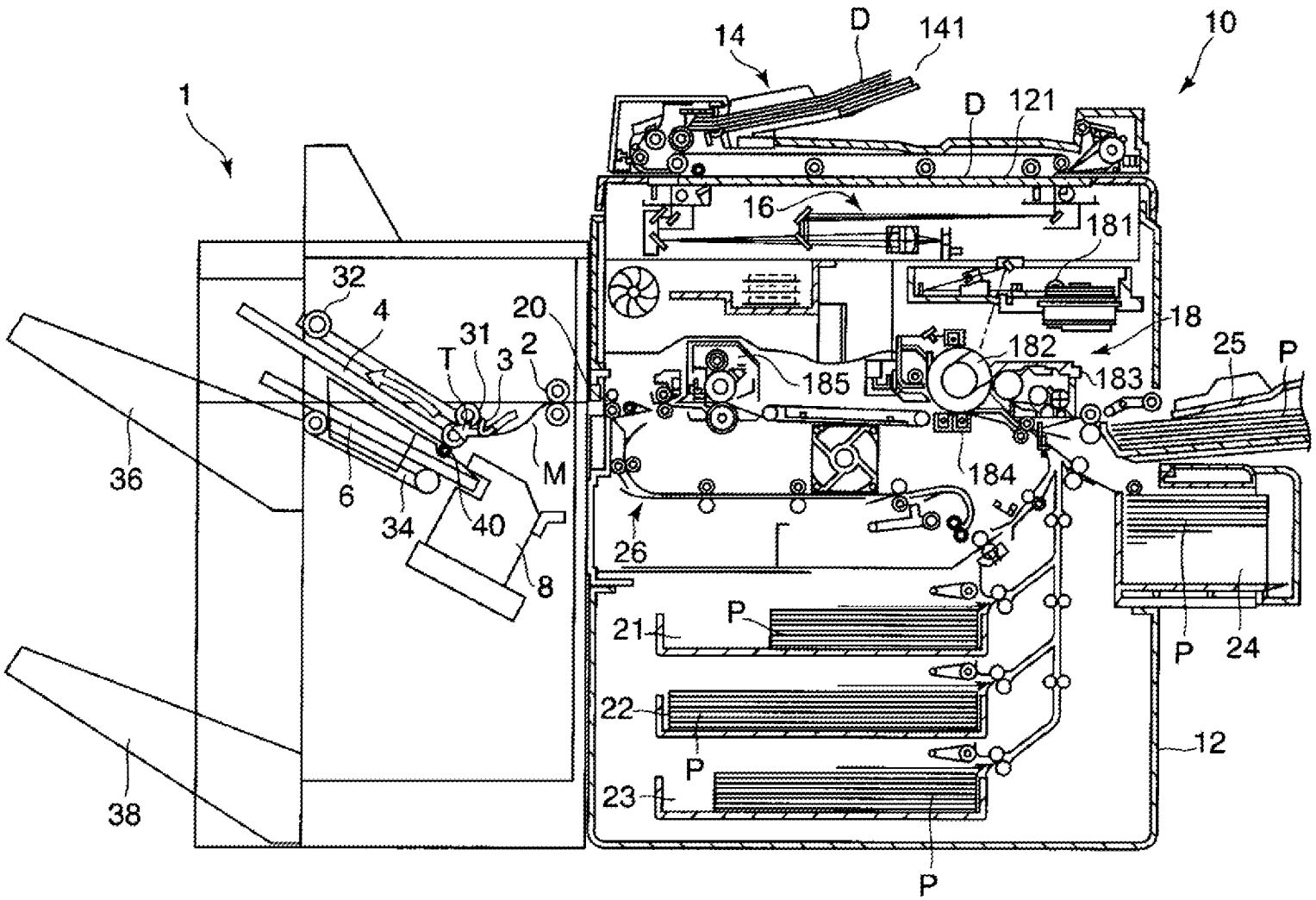
FIG. 1 is a schematic diagram of a multifunction peripheral equipped with a finisher according to one embodiment.

In general, according to one embodiment, a paper sheet processing apparatus includes a processing tray, a feed member, a drive unit, a detection unit, and a control unit. The processing tray receives and stacks a plurality of paper sheets. The feed member is rotatably arranged above the processing tray to face the processing tray and includes a paddle that is elastically deformed by being pressed against the paper sheets during rotation to scrape the paper sheets stacked on the processing tray toward an alignment surface by the paddle. The drive unit rotates the feed member. The detection unit is arranged between the feed member and the alignment surface and detects a leading end of the paper sheet being fed toward the alignment surface by the paddle. The control unit controls the drive unit based on a detection result of the detection unit during the period from if the detection unit detects the leading end of the paper sheet to if the paddle separates from the paper sheet and controls the rotation of the feed member so that the leading end of the paper sheet scraped by the paddle is aligned with the alignment surface.

A multifunction peripheral 10 equipped with a finisher 1 according to one embodiment will be described below with reference to the drawings. In the drawings used for the following description, the scale of each part may be changed as appropriate. Also, in the drawings used in the following description, the configuration may be omitted in some cases for the sake of easy understanding of the description.

As shown in FIG. 1, the multifunction peripheral 10 includes a housing 12 forming the outer shell of the device and includes a document table 121 made of a transparent glass plate on the upper surface of a housing 12. An automatic document feeder 14 (hereinafter, simply referred to as ADF 14) is placed on the document table 121. The ADF 14 can open and close the document table 121. The ADF 14 automatically feeds a document D to a reading position on the document table 121.

For example, if the operator sets the document D on a paper feed tray 141 of the ADF 14 and sets the presence or absence of stapling, the method of stapling, the number of copies, the paper size, and the like, and then presses the copy start switch, the multifunction peripheral 10 automatically feeds the documents D on the paper feed tray 141 one by one to the document reading position on the document table 121. After reading the document D, the multifunction peripheral 10 automatically discharges the document D at an appropriate timing.

Various data input by the operator can be performed via the control panel of the multifunction peripheral 10 or via an external device such as a personal computer connected to the multifunction peripheral 10.

The multifunction peripheral 10 includes a scanner unit 16, a printer unit 18, cassettes 21, 22, and 23 for paper P, and the like inside the housing 12. The multifunction peripheral 10 also includes a large-capacity feeder 24 containing a large amount of paper of the same size and a manual feed tray 25 on the right wall of the housing 12 in the drawing which will be described later. Further, the multifunction peripheral 10 has the finisher 1 connected to the left wall of the housing 12 in the drawing. The finisher 1 is an example of the paper sheet processing apparatus described in the claims of the present application.

The scanner unit 16 illuminates and scans the document D fed to the document reading position on the document table 121 by the ADF 14, reads and photoelectrically converts the reflected light, and obtains image information of the document D.

The printer unit 18 operates a laser device 181 based on the image information read by the scanner unit 16 to form an electrostatic latent image on the circumferential surface of a photosensitive drum 182 based on the image information. The printer unit 18 supplies toner to the electrostatic latent image on the photosensitive drum 182 via a developing device 183 to visualize the latent image, and transfers the toner image to the paper P by a transfer charger 184. At this time, the multifunction peripheral 10 feeds the paper P from the cassettes 21, 22, and 23, a large-capacity feeder 24, or the manual feed tray 25.

Further, the multifunction peripheral 10 supplies the paper P onto which the toner image was transferred to a fixing device 185, heats, melts, and then fixes the toner image on the paper P, and discharges the paper to the finisher 1 through a discharge port 20. After passing through the fixing device 185, the multifunction peripheral 10 conveys the paper P, which requires double-sided copying, to a reversing conveying path 26 and reverses the front and back sides of the paper P, and then sends to the fixing region between the photosensitive drum 182 and the fixing device 185 again.

The paper P discharged through the discharge port 20 is an example of paper sheets described in the claims of the present application. Hereinafter, for convenience of explanation, the paper P discharged to the finisher 1 through the discharge port 20 of the multifunction peripheral 10 will be referred to as a paper sheet M.

The finisher 1 stacks and aligns the paper on which images are formed, that is, the paper sheets M discharged through the discharge port 20 of the multifunction peripheral 10, and staples each unit of paper sheets M with the stapler 8, with a predetermined number of stacked paper sheets M as one unit. The stapling process refers to a process of aligning and binding one-side ends of a plurality of stacked paper sheets M.

The finisher 1 includes an entrance roller 2 and an entrance sensor 3 at a position facing the discharge port 20 of the multifunction peripheral 10. The entrance sensor 3 detects the passage of the leading end and the trailing end of the paper sheet M fed into the finisher 1 via the entrance roller 2 in the feeding direction (direction of arrow T in the drawing).

The finisher 1 includes a standby tray 4, a processing tray 6, and a stapler 8. The standby tray 4 stacks and waits for two or three paper sheets M fed in the direction of the arrow T through the entrance roller 2. The processing tray 6 receives the paper sheets M dropped from the standby tray 4 and aligns the trailing ends thereof for stapling. The stapler 8 staples the trailing ends of the paper sheets M stacked and aligned on the processing tray 6. The standby tray 4 and the processing tray 6 are inclined downward toward the trailing ends of the paper sheets M in the feeding direction.

Since the stapling process by the stapler 8 requires a certain amount of processing time, when one unit of the paper sheets M on the processing tray 6 is being stapled, several paper sheets M fed as the next unit are required to stand by at a place different from the processing tray 6. In the present embodiment, if the preceding one unit of paper sheets M is being stapled, two of the next one unit of paper sheets M are made to stand by on the standby tray 4, and the time for stapling the preceding one unit of paper sheets M is ensured.

That is, the first paper sheet M and the second paper sheet M fed in the direction of the arrow T are stacked on the standby tray 4 and after the preceding one unit of stapling is completed, two paper sheets M made to stand by are dropped onto the processing tray 6, and the third and subsequent paper sheets M are directly stacked on the processing tray 6 via the standby tray 4.

Figure 2:
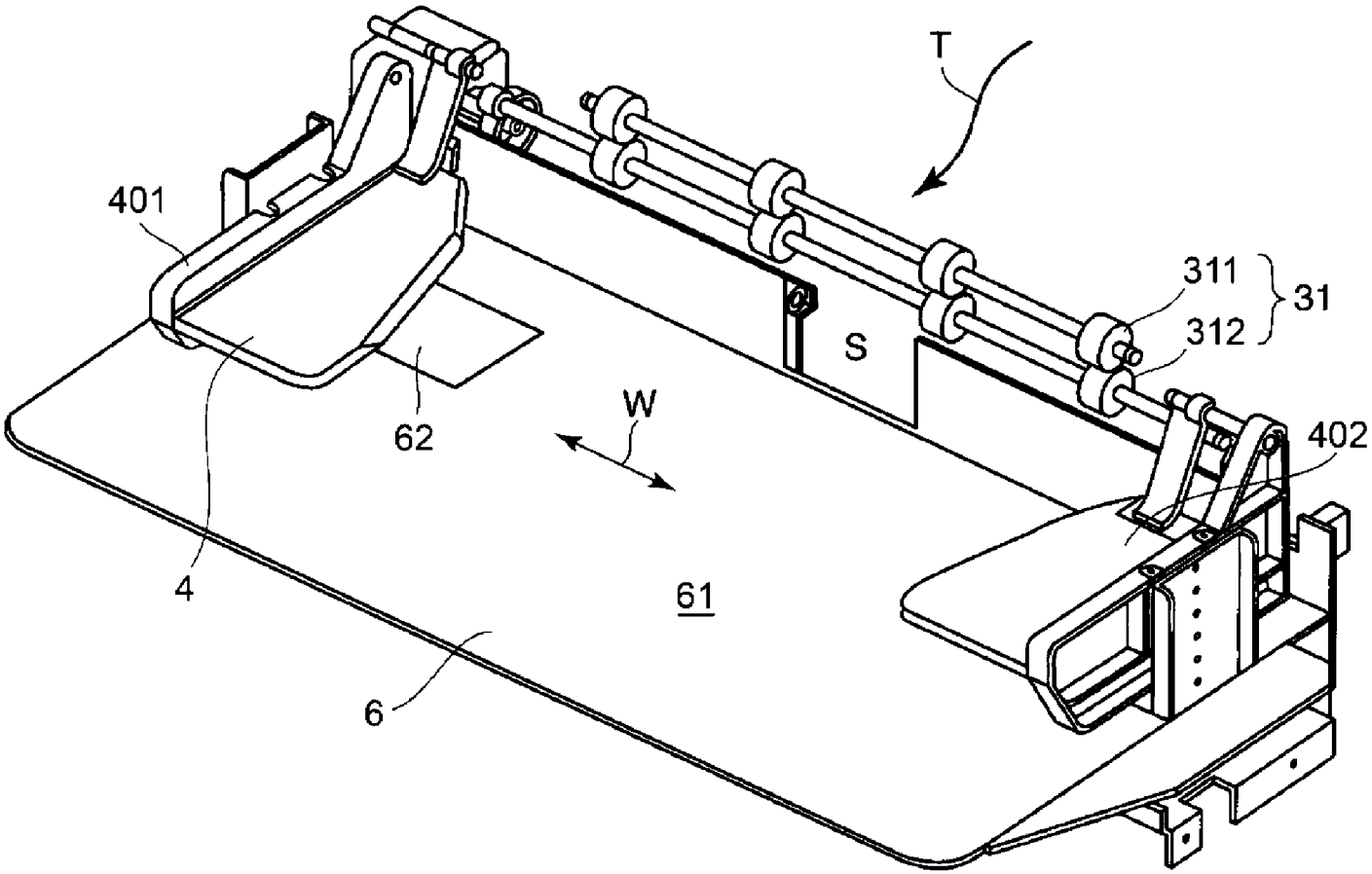
FIG. 2 is a perspective view showing a standby tray and a processing tray of the finisher.

As shown in FIG. 2, the standby tray 4 includes two opening and closing trays 401 and 402 that open and close in a direction crossing the feeding direction T of the paper sheets M (the direction of the arrow W in the drawing) (hereinafter, this direction is referred to as the width direction W). The opening and closing trays 401 and 402 are connected to a motor, for example, via a rack and pinion mechanism (not shown), and open and close between a support position for supporting the paper sheet M fed in the direction of the arrow T near the trailing end corners in the feeding direction, and a release position where the support is released.

If the opening and closing trays 401 and 402 are opened to the release position, the paper sheets M stacked on the standby tray 4 drop onto the processing tray 6 due to their own weight. At this time, since the width of the opening formed between the two opening and closing trays 401 and 402 widens toward the upstream side in the feeding direction, if the opening and closing trays 401 and 402 are opened, the trailing ends of the stacked paper sheets M in the feeding direction first fall toward the processing tray 6.

On the upstream side of the standby tray 4 in the feeding direction, there is a paper feed roller 31 that clamps the paper sheets M fed in the direction of the arrow T and feeds the clamped paper sheets M to the standby tray 4, as shown in FIG. 1. The paper feed roller 31 includes a plurality of upper rollers 311 and lower rollers 312 facing each other. The paper feed roller 31 starts the rotation if the entrance sensor 3 detects the leading end passage in the feeding direction of the paper sheet M as a trigger and stops the rotation if the entrance sensor 3 detects the trailing end passage in the feeding direction of the paper sheet M as a trigger.

As shown in FIG. 1, the finisher 1 includes a standby tray roller 32 (not shown in FIG. 2) downstream of the standby tray 4 in the feeding direction. The standby tray roller 32 is arranged to face the mounting surface of the standby tray 4 so as to be separable and rotatable in both forward and reverse directions. That is, the standby tray roller 32 rotates in the reverse direction to slightly convey and align the paper sheet M fed to the standby tray 4 in the direction opposite to the feeding direction T, and after stacking the paper sheets M which do not require stapling on the standby tray 4, the standby tray roller 32 rotates forward to discharge the paper sheets toward the discharge trays 36 and 38. The discharge trays 36 and 38 can move up and down.

When stacking the paper sheets M on the standby tray 4, the finisher 1 retracts the standby tray roller 32 upward and lowers the standby tray roller 32 toward the standby tray 4 after stacking the paper sheets M. The finisher 1 rotates the standby tray roller 32 in the reverse direction while keeping the standby tray roller 32 in contact with the paper sheets M stacked on the standby tray 4, and then aligns the paper sheets by abutting the trailing end of the paper sheets M in the feeding direction against a stopper (not shown). After that, the standby tray roller 32 is retracted upward again in order to receive the paper sheet M to be fed next onto the standby tray 4.

The processing tray 6 has a flat mounting surface 61 on its bottom for placing and stacking the paper sheets M dropped from the standby tray 4. The mounting surface 61 is inclined downward toward the upstream side in the feeding direction of the paper sheets M. Under the processing tray 6, there is a conveying mechanism 34 (see FIG. 1) for conveying the paper sheets M stacked and placed on the processing tray 6 toward the discharge trays 36 and 38, which will be described later. The processing tray 6 has an opening 62 at its bottom for exposing a portion of the conveying mechanism 34 above the mounting surface 61.

Figure 3:
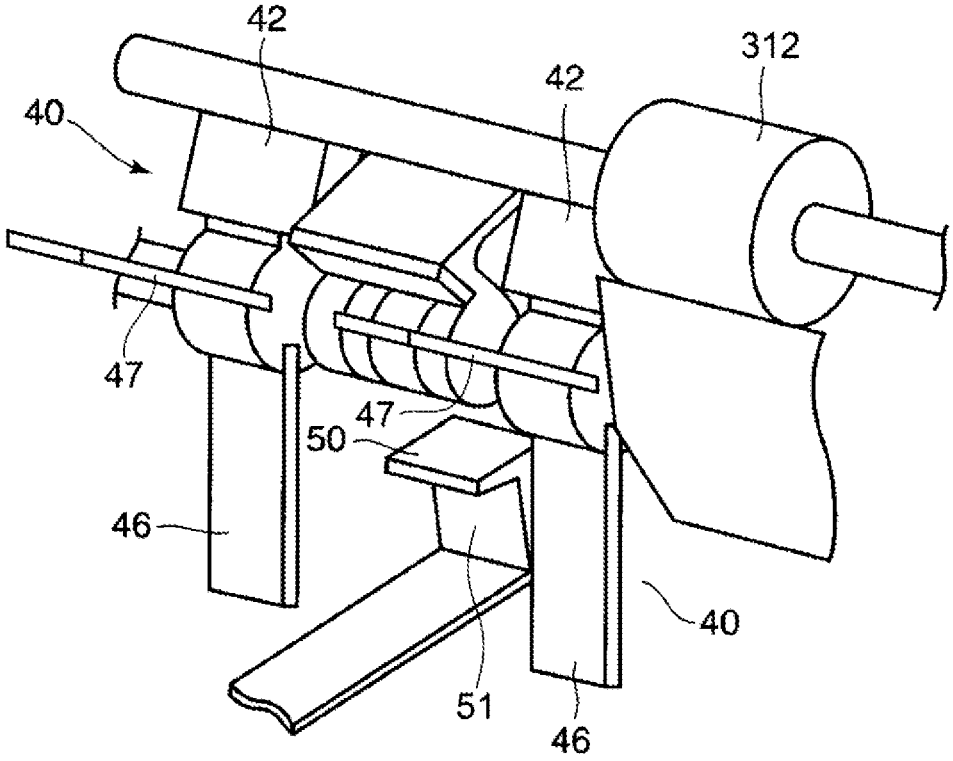
FIG. 3 is a partially enlarged perspective view showing a feed member of the finisher.

Between the standby tray 4 and the processing tray 6, there are two feed members 40 as partially enlarged in FIG. 3. In the present embodiment, two feed members 40 are provided spaced apart from each other in the rotation axis direction, but three or more feed members 40 may be provided. The structure shown in FIG. 3 is incorporated in the space indicated by S in FIG. 2.

The feed member 40 acts on the trailing end of the paper sheets M received in the standby tray 4 in the feeding direction. The feed member 40 guides the trailing end of the paper sheet M toward the processing tray 6. Further, the feed member 40 scrapes the vicinity of the trailing end of the paper sheet M dropped onto the processing tray 6 in the direction opposite to the feeding direction.

Figure 4:
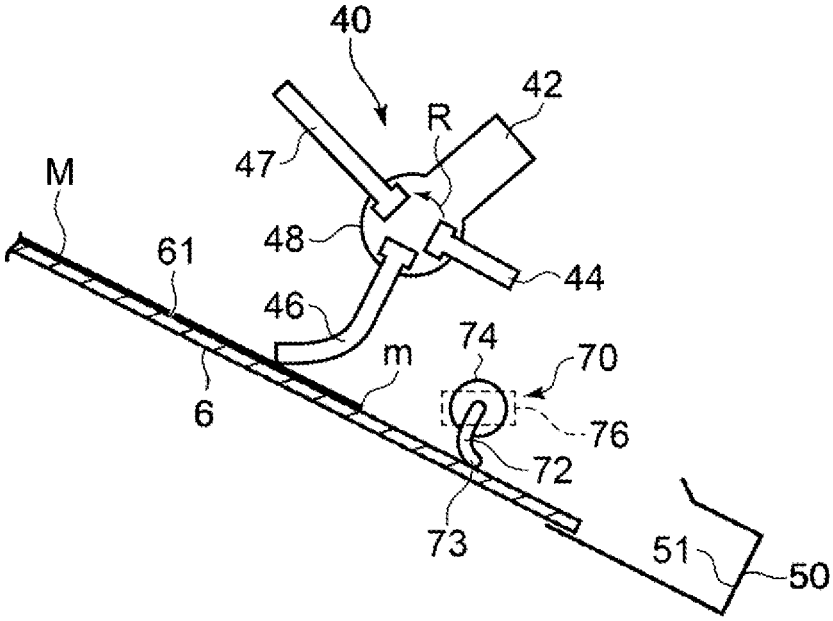
FIG. 4 is a front view of the feed member.

As shown in FIG. 4, each feed member 40 includes a receiving portion 42 for supporting from below the trailing end of the paper sheet M fed to the standby tray 4 in the feeding direction, a hitting portion 44 for hitting down the trailing end supported by the receiving portion 42, a paddle 46 for scraping the vicinity of the trailing end of the paper sheet M dropped on the processing tray 6 toward the stopper 50, an auxiliary paddle 47, and a rotating body 48. The rotating body 48 fixes the trailing ends of the receiving portion 42, the hitting portion 44, the paddle 46, and the auxiliary paddle 47, spaced apart in the circumferential direction.

The protruding length of the auxiliary paddle 47 from the rotating body 48 is slightly shorter than the protruding length of the paddle 46. The protruding length of the paddle 46 and the auxiliary paddle 47 is such that the leading end of each paddle at least contacts the mounting surface 61 of the processing tray 6 during the rotation of the feed member 40. The feed member 40 rotates in the direction of arrow R (counterclockwise direction) in the drawing.

The basic operation of the finisher 1 described above will be described below with reference to FIGS. 5 to 9. In the following description, the direction in which the paper sheets M are fed from the multifunction peripheral 10 to the standby tray 4 of the finisher 1 is referred to as the feeding direction, and the direction of scraping and feeding the paper sheets M that dropped from the standby tray 4 to the processing tray 6 toward the stopper 50 is referred to as the abutting direction. Further, in the following description, the trailing end of the paper sheet M in the feeding direction may be referred to as the leading end m in the abutting direction.

Figure 5:
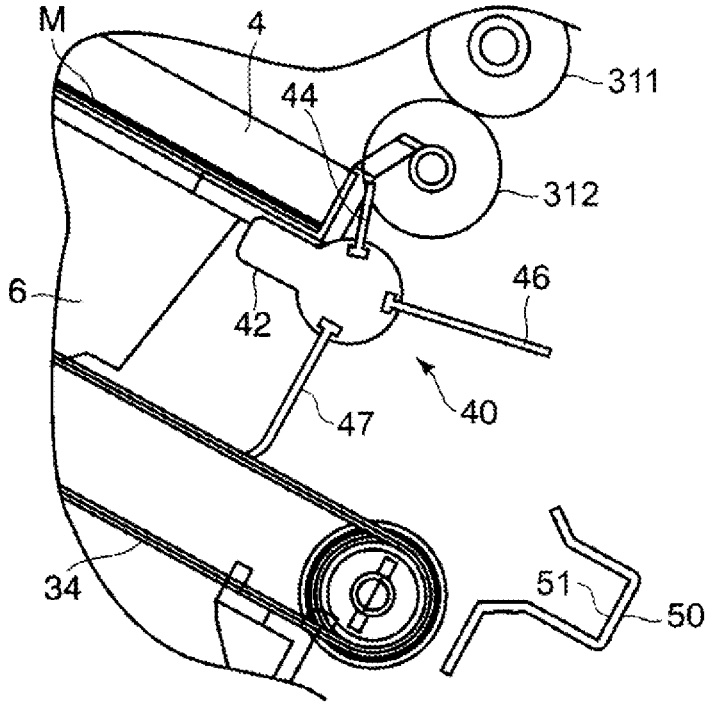
FIG. 5 is a diagram illustrating the operation of the feed member.

First, if the paper sheet M is fed from the multifunction peripheral 10 to the finisher 1, the feed member 40 is on standby while being rotated to the home position shown in FIG. 5. In this state, if the paper sheet M is fed to the standby tray 4, the trailing end of the paper sheet M in the feeding direction rides on the receiving portion 42 of the feed member 40. As described above, the standby tray 4 is inclined downward toward the upstream side in the feeding direction. Therefore, the paper sheet M fed to the standby tray 4 is biased toward the trailing end side by its own weight, and the center of the trailing end of the paper sheet M hangs downward from between the opening and closing trays 401 and 402. In other words, the receiving portion 42 of the feed member 40 supports the vicinity of the center of the trailing end of the hanging paper sheet M from below.

Figure 6:
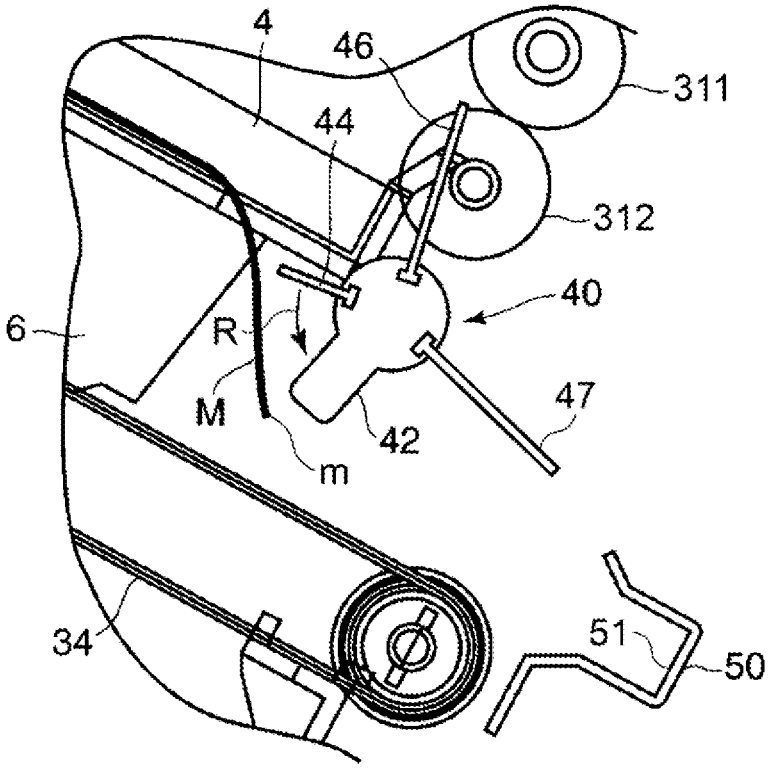
FIG. 6 is a diagram illustrating the operation of the feed member.

In this state, if the second paper sheet M is fed to the standby tray 4, the second paper sheet M overlaps the first paper sheet M, and the trailing end of the second paper sheet M rides on the receiving portion 42 of the feed member 40. After that, the finisher 1 opens the opening and closing trays 401 and 402, rotates the feed member 40 as shown in FIG. 6 to release the support by the receiving portion 42, to hit the trailing ends of the paper sheets M by the hitting portion 44, and to make the paper sheets M in a state of being two-ply drop toward the processing tray 6. Here, a case will be described in which one paper sheet M is made to stand by on the standby tray 4 and drop onto the processing tray 6, but the number of paper sheets M stacked on the standby tray 4 before being hit down can be changed to any number.

As described above, since the width of the opening between the opening and closing trays 401 and 402 widens toward the upstream in the feeding direction, the trailing end side of the paper sheet M on the standby tray 4 is released from the support first, as shown in FIG. 6, the trailing end is first directed to the processing tray 6. At the same time, since the center of the trailing end of the paper sheet M is hit downward toward the processing tray 6 by the hitting portion 44, the trailing end of the paper sheet M is forcibly directed toward the processing tray 6 first.

Figure 7:
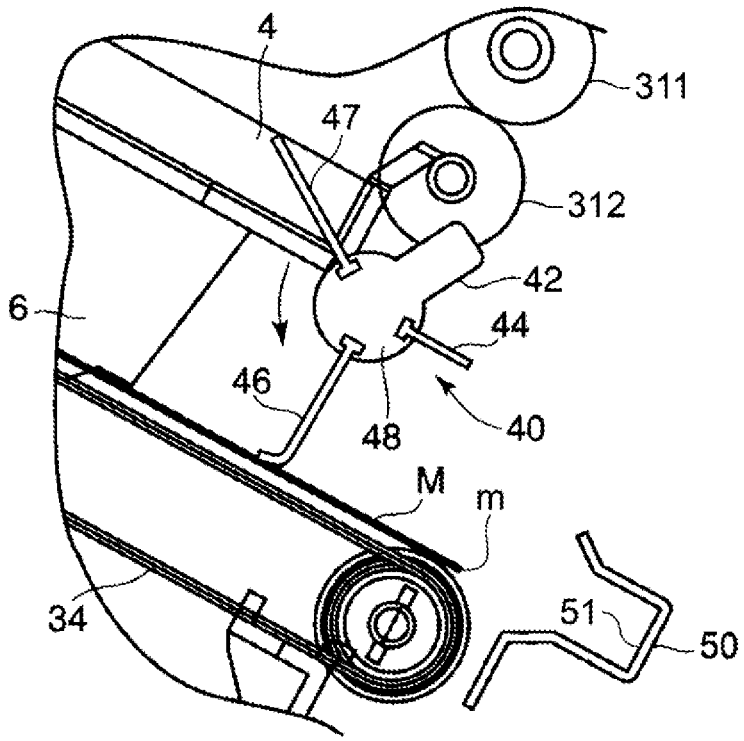
FIG. 7 is a diagram illustrating the operation of the feed member.

After the paper sheet M drops onto the processing tray 6, if the feed member 40 is further rotated from the state shown in FIG. 6, the leading end of the paddle 46 of the feed member 40 comes into contact with the upper surface of the paper sheet M as shown in FIG. 7. If the feed member 40 is further rotated from this state, the paddle 46 elastically deforms and moves while curving, after the elastic deformation of the paddle 46 reaches its peak, if the leading end of the paddle 46 in the protruding direction separates from the paper sheet M, the paper sheet M is flipped off toward the stopper 50 by the restoring force of the paddle 46. That is, the paddle 46 operates to scrape the vicinity of the trailing end (that is, the leading end m in the hitting direction) of the paper sheet M toward the stopper 50.

Also, at this time, the conveying mechanism 34 operates to convey the paper sheets M stacked on the processing tray 6 toward the stopper 50 in cooperation with the scraping operation of the paddle 46. The length of the paddle 46 is such that it can at least be pressed against the processing tray 6 if the feed member 40 is rotated. Therefore, the paddle 46 is pressed against the upper surface of the paper sheet M on the processing tray 6 and is elastically deformed and curved.

Figure 8:
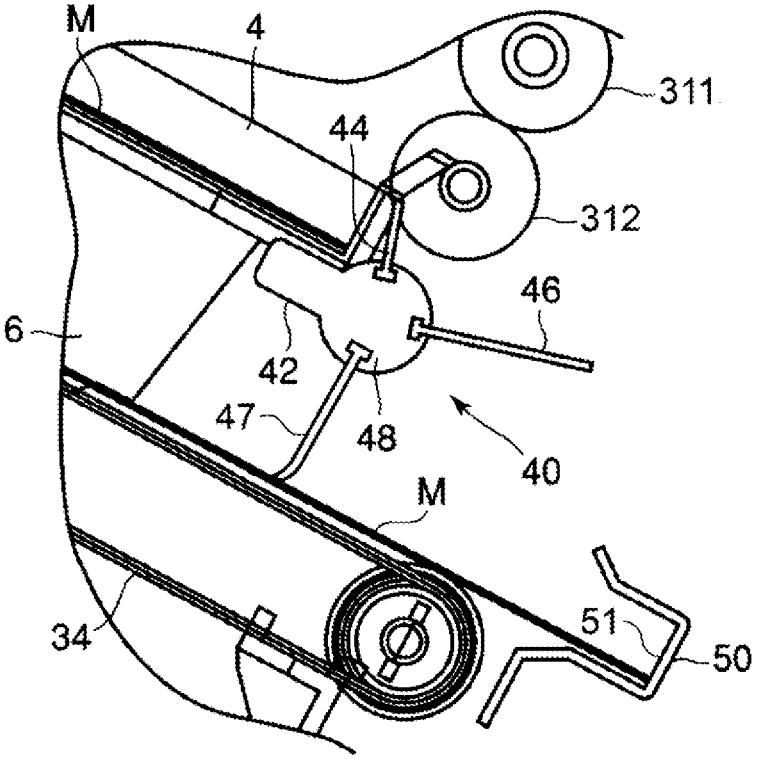
FIG. 8 is a diagram illustrating the operation of the feed member.

After that, as shown in FIG. 8, the feed member 40 is rotated to the same posture (home position) as if the paper sheet M was received, and the next paper sheet M is conveyed to the standby tray 4. The trailing end of the paper sheet M in the feeding direction is supported by the receiving portion 42 of the feed member 40. A predetermined number of paper sheets M are stacked on the processing tray 6 by repeating the above operation. If a plurality of paper sheets M are to wait in the standby tray 4, the rotation of the feed member 40 only needs to be stopped until the waiting number of paper sheets M are conveyed to the standby tray 4.

The leading end of the auxiliary paddle 47 comes into contact with the upper surface of the paper sheet M immediately before the feed member 40 rotates to the position shown in FIG. 8. The auxiliary paddle 47 functions to prevent the paper sheet M from rebounding if the paper sheet M whose leading end m in the abutting direction abuts against the alignment surface 51 of the stopper 50 tries to return in the opposite direction. Further, the auxiliary paddle 47 functions to feed the paper sheet M whose leading end m did not reach the alignment surface 51 of the stopper 50 toward the alignment surface 51.

Figure 9:
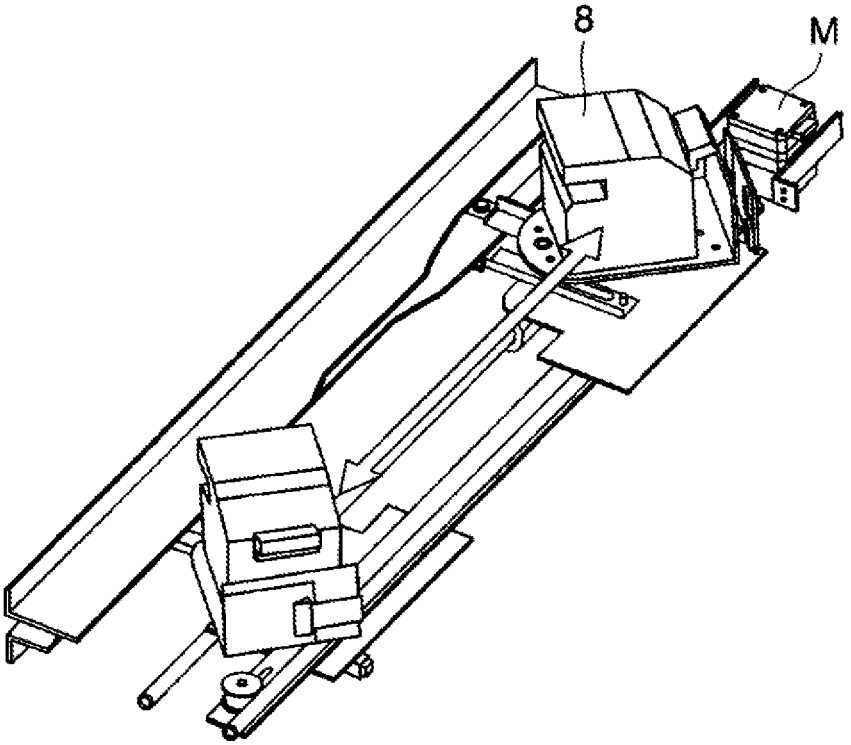
FIG. 9 is a perspective view showing a stapler of the finisher.

As described above, if a predetermined number of paper sheets M are stacked on the processing tray 6 and their leading ends m in the abutting direction are aligned, the finisher 1 moves the stapler 8 movably installed along the leading ends m to the stapling position as shown in FIG. 9, and binds a predetermined number of paper sheets M in one unit at an appropriate position. After that, the finisher 1 operates the conveying mechanism 34 to convey the bundle of paper sheets M bound at the leading ends m toward the discharge trays 36 and 38.

Since the paper sheet M fed from the multifunction peripheral 10 to the finisher 1 just underwent image formation, the paper sheet M may be slightly curled due to the application of heat. The degree of curling of the paper sheet M varies depending on the thickness, basis weight, size, and the like of the paper P even if the amount of heat given by the fixing device 185 is the same. In addition, since the finisher 1 needs to drop the paper sheet M from the standby tray 4 to the processing tray 6, the stacking posture of the paper sheets M on the processing tray 6 tends to vary. Therefore, it is difficult to neatly align the leading ends m of all the paper sheets M in the abutting direction with the alignment surface 51 by simply processing all the paper sheets M fed to the processing tray 6 of the finisher 1 in the same manner of rotating the feed member 40 at the same timing and at the same speed. By providing the above-described auxiliary paddle 47, the leading ends m can be aligned with the alignment surface 51 to some extent, but it cannot be said to be sufficient.

On the other hand, the inventors of the present application have proposed that, in order to further improve the alignment of the leading ends m of the paper sheets M on the processing tray 6 of the finisher 1, the rotation speed and the control timing of the feed member 40 are adjusted according to the state of the paper sheets M that dropped onto the processing tray 6. A configuration for controlling the rotation of the feed member 40 and a control method thereof will be described below.

As shown in FIG. 4, the finisher 1 includes a detection unit 70 that detects the leading end m of the paper sheet M being scraped toward the alignment surface 51 of the stopper 50 by the paddle 46 of the feed member 40. The detection unit 70 is located above the mounting surface 61 of the processing tray 6 to face the mounting surface 61 with a space therebetween. The detection unit 70 is between the feed member 40 and the alignment surface 51. In other words, the detection unit 70 detects the passage of the leading end m of the paper sheet M that passed through the feed member 40 and is directed toward the alignment surface 51. The detection unit 70 includes a contactor 72, a magnet 74, and an angle sensor 76.

The contactor 72 has a shape curved in the direction of the alignment surface 51 toward the mounting surface 61 from a position spaced above the mounting surface 61 of the processing tray 6. The contactor 72 is rotatable with respect to the housing of the finisher 1. The contactor 72 has a contact end 73 near the leading end of rotation, which contacts the upper surface of the paper sheet M during rotation. If the contact end 73 contacts the paper sheet M, the contactor 72 is lifted by the thickness of the paper sheet M and rotates slightly counterclockwise in the drawing.

Figure 10:
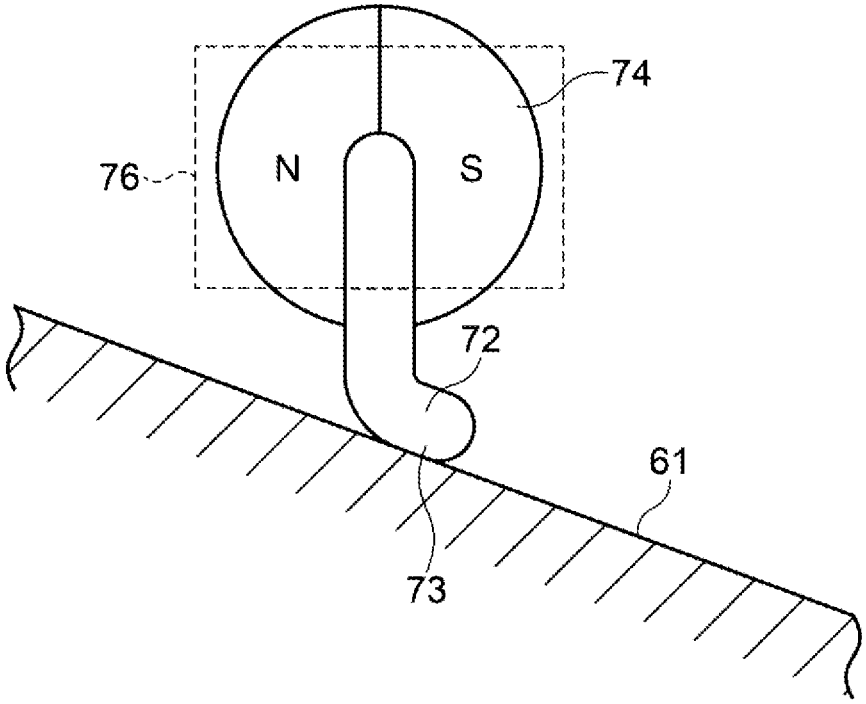
FIG. 10 is a diagram illustrating a paper sheet detection method by a detection unit.
Figure 11:
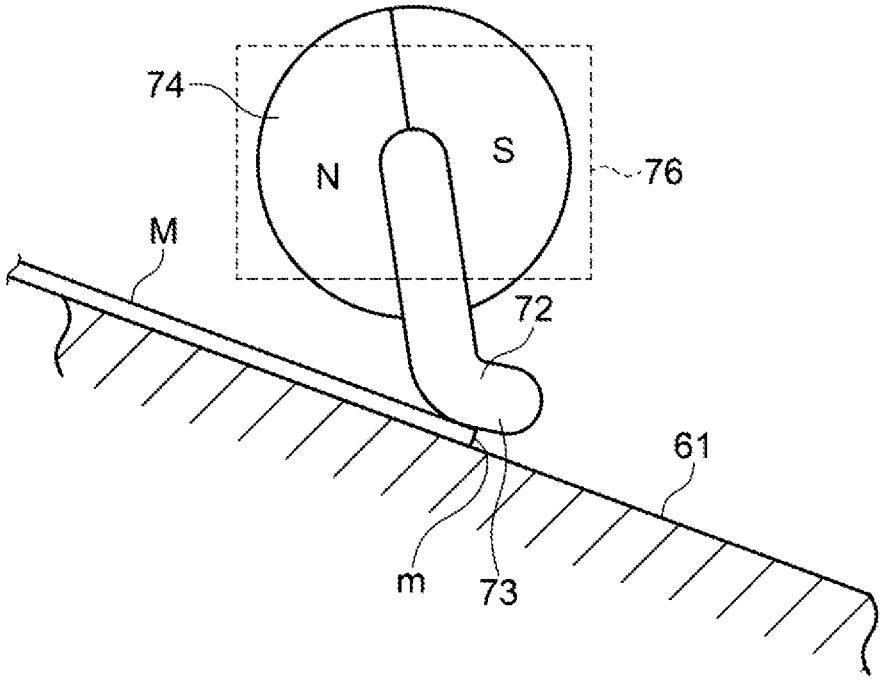
FIG. 11 is a diagram illustrating the paper sheet detection method by the detection unit in addition to FIG. 10.

FIG. 10 shows an example of a state in which there is no paper sheet M between the contact end 73 of the contactor 72 and the mounting surface 61 of the processing tray 6, and FIG. 11 shows an example of a state in which the leading end m of the paper sheet M is inserted therebetween. Before the paper sheet M is sent to the processing tray 6 (the state shown in FIG. 10), the contactor 72 presses the contact end 73 against the mounting surface 61 by its own weight. As shown in FIG. 11, if the leading end m of the paper sheet M is sent between the mounting surface 61 and the contact end 73, the contact end 73 is pushed up by the thickness of the paper sheet M, and the contactor 72 rotates slightly counterclockwise in the drawing.

The magnet 74 can rotate integrally with the contactor 72. The magnet 74 is, for example, disc-shaped and is polarized in a plane including its central axis. The rotating base end portion of the contactor 72 can rotate coaxially with the central axis of the magnet 74. That is, if the leading end m of the paper sheet M reaches the contact end 73 of the contactor 72 and the contactor 72 rotates in the direction in which the contact end 73 moves away from the mounting surface 61, the magnet 74 also rotates by the same angle in the same direction.

The angle sensor 76 faces across the two magnetic poles of the magnet 74 and is fixed to the housing of the finisher 1. The angle sensor 76 detects a change in the direction of the magnetic field that changes due to the rotation of the magnet 74, and detects the rotation angle of the magnet 74, that is, the rotation angle of the contactor 72 from the amount of change. By sufficiently increasing the resolution of the angle sensor 76, slight rotation of the contactor 72 corresponding to the thickness of the paper sheet M can be detected.

For example, if the next paper sheet M is sent to the processing tray 6 in a state where several paper sheets M are stacked on the processing tray 6, the contact end 73 of the contactor 72 is in contact with the upper surface of the uppermost paper sheet M of already stacked several paper sheets M. If a new paper sheet M is fed between the contact end 73 and the contact end 73 from this state, the contactor 72 rotates by the thickness of the paper sheet M. That is, the detection unit 70 can detect the leading end m of the newly fed paper sheet M regardless of the number of paper sheets M already stacked on the processing tray 6. Since the contact end 73 of the contactor 72 moves in an arc shape, strictly speaking, the position in the abutting direction for detecting the leading end m shifts slightly depending on the number of paper sheets M stacked on the processing tray 6.

Figure 12:
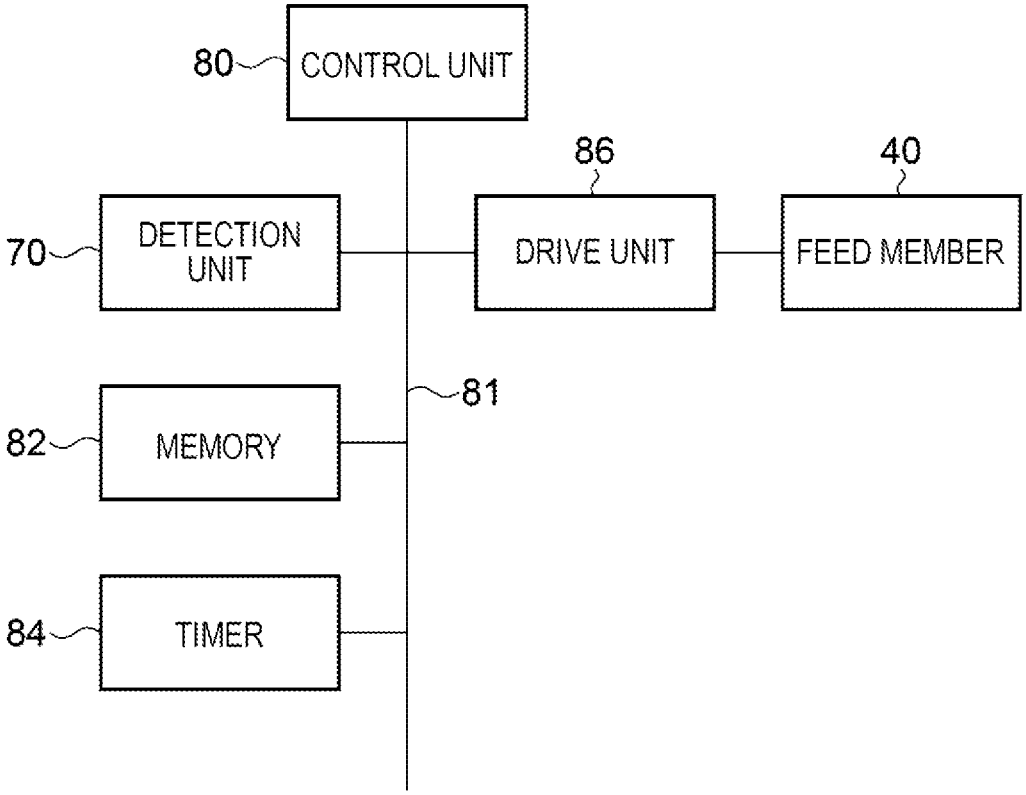
FIG. 12 is a block diagram of a control system that controls the operation of the feed member.

As shown in FIG. 12, the finisher 1 includes a control unit 80 that controls the rotation of the feed member 40. The control unit 80 connects the detection unit 70, a memory 82, a timer 84, and a drive unit 86 via a bus line 81.

The detection unit 70 detects the leading end m of the paper sheet M that was fed into the processing tray 6 and is being scraped toward the alignment surface 51 by the paddle 46. The memory 82 stores a control table in which the optimal deceleration and deceleration start timing of the feed member 40 with respect to the output value of the detection unit 70 are measured in advance for each thickness, basis weight, and size of the paper P. The optimal deceleration and deceleration start timing of the feed member 40, which were measured in advance for each thickness, basis weight, and size of the paper P, are examples of optimal control values described in the claims of the present application and are the optimal values for aligning the paper sheet M with the alignment surface 51.

The timer 84 measures the time from if the feed member 40 is rotated from the home position shown in FIG. 5 to if the detection unit 70 detects the leading end m of the paper sheet M. The drive unit 86 is a motor or the like that rotates the feed member 40 at a variable speed based on the detection result of the detection unit 70.

Figure 13:
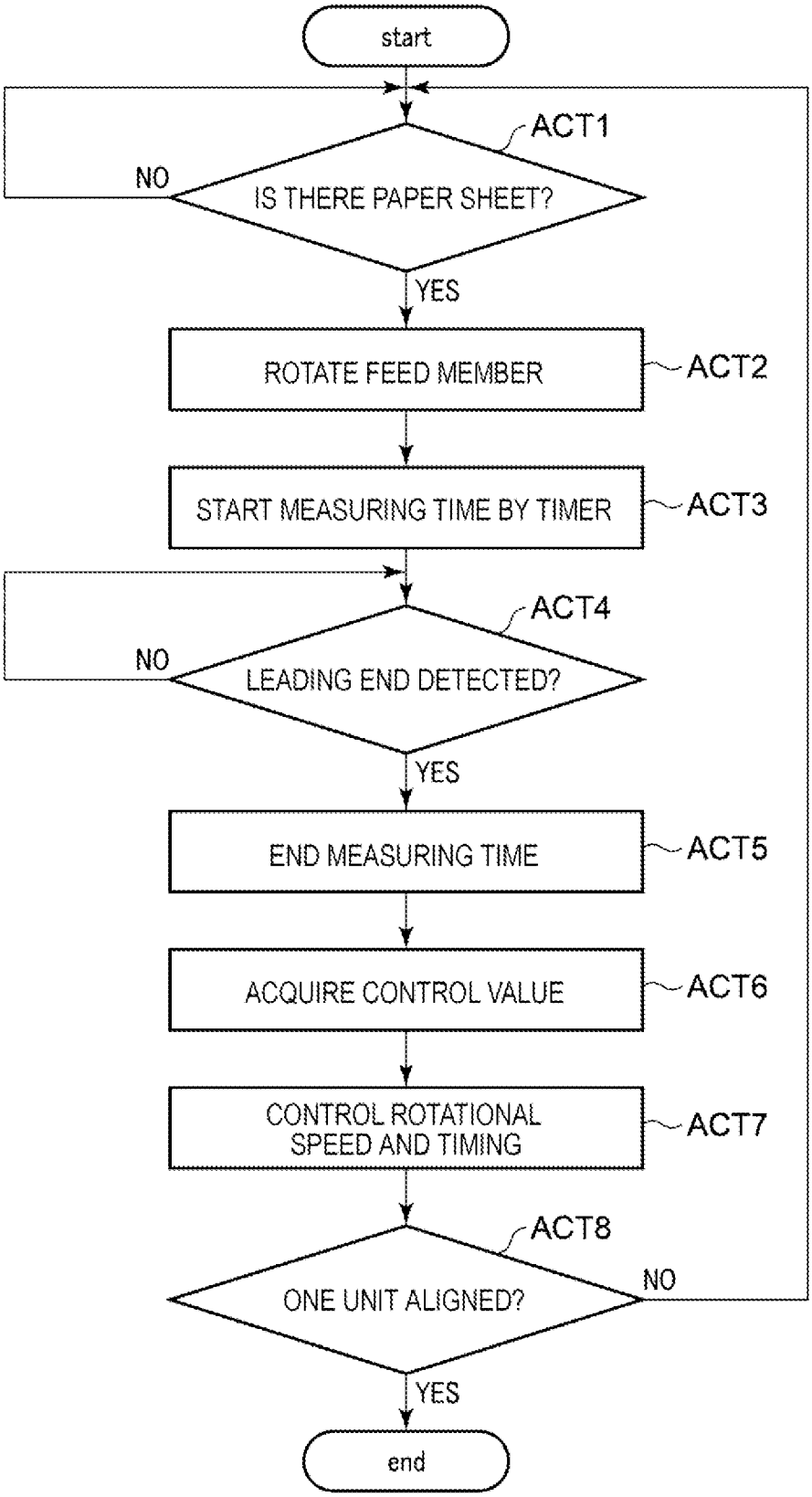
FIG. 13 is a flowchart illustrating the operation of the feed member.

As shown in FIG. 13, the finisher 1 waits for the paper sheet M to be fed from the multifunction peripheral 10 in ACT 1. In the standby state before the paper sheet M is fed to the standby tray 4, the feed member 40 is rotated to the home position shown in FIG. 5 and stopped. If the paper sheet M is fed from the multifunction peripheral 10 to the finisher 1 (ACT 1; YES), the control unit 80 controls the drive unit 86 to rotate the feed member 40 from the home position, and drops the paper sheet M in the standby tray 4 onto the processing tray 6 in ACT 2. At this time, the finisher 1 opens the standby tray 4 to the release position as the feed member 40 rotates.

The control unit 80 rotates the feed member 40 in ACT 2, and at the same time, starts measuring the time by the timer 84 in ACT 3, and continues measuring the time until the detection unit 70 detects the leading end m of the paper sheet M in ACT 4 (ACT 4; YES) (ACT 5). After that, the control unit 80 acquires the optimal control value from the control table stored in the memory 82 based on the time measured in ACT 5 and the information of the paper P (thickness, basis weight, size, and the like) input in advance (ACT 6), and controls the drive unit 86 according to the control value (ACT 7). The time from if the feed member 40 is rotated until the detection unit 70 detects the leading end m of the paper sheet M includes the information about the position of the leading end m of the paper sheet M dropped onto the processing tray 6 along the abutting direction.

The control of ACT 7 includes control of the rotation speed of the feed member 40 and control of the timing of the control start. For example, if the leading end m of the paper sheet M that dropped onto the processing tray 6 is placed at a position farther from the alignment surface 51 than the designed value, the time measured by the timer 84 in ACT 5 becomes longer than the designed value. In this case, the control unit 80 controls the drive unit 86 so as to decrease the deceleration of the feed member 40 or delay the start timing of deceleration. Further, if the leading end m of the paper sheet M that dropped onto the processing tray 6 is positioned at a position closer to the alignment surface 51 than the designed value, the time measured by the timer 84 in ACT 5 becomes shorter than the designed value. In this case, the control unit 80 controls the drive unit 86 so as to increase the deceleration of the feed member 40 or advance the deceleration start timing. In any case, the control unit 80 controls the rotation of the feed member 40 so that the leading ends m of all the paper sheets M abut against the alignment surface 51 at approximately the same speed and aligned.

The control unit 80 repeats the processes of ACT 1 to ACT 7 until a predetermined number of paper sheets M of one unit are stacked on the processing tray 6 and the leading ends m are aligned, and the leading ends m of the predetermined number of paper sheets M of one unit are aligned (ACT 8; YES), and the process ends. After that, the finisher 1 uses the stapler 8 to staple the leading ends m of the predetermined number of paper sheets M.

As described above, according to the present embodiment, even if the position of the leading end m of the paper sheet M dropped from the standby tray 4 to the processing tray 6 varies in the abutting direction, the leading ends m of all the paper sheets M can be neatly aligned with the alignment surface 51. Therefore, according to the present embodiment, the stapled bundle of paper sheets M is neatly arranged, and the reliability of the finisher 1 can be improved.

Further, according to the present embodiment, the memory 82 stores a control table in which the optimal control values for the feed member 40 are measured in advance according to the thickness, basis weight, size, and the like of the paper P on which the image is to be formed by the multifunction peripheral 10. Then, after the feed member 40 is rotated, the optimal control value based on the time until the detection unit 70 detects the leading end of the paper sheet M is read out from the control table, and the feed member 40 is controlled to rotate. Therefore, regardless of the type of paper P, the leading ends m of the paper sheets M can be neatly aligned before stapling. Further, according to the present embodiment, since the thickness of the paper sheet M can be detected via the detection unit 70, rotation control based on an optimal control value matching the thickness detected by the detection unit 70 is also possible.

Further, as described above, the contact end 73 of the contactor 72 swings to draw an arc track. Depending on the number of the paper sheets M fed to the processing tray 6, the detection unit 70 makes a difference in the position in the abutting direction for detecting the leading end m. For example, the position for detecting the leading end m of the seventh paper sheet M fed on top of the six stacked paper sheets M is the side closer to the alignment surface 51 from the position for detecting the leading end of the second paper sheet M. Therefore, in consideration of this difference, an optimal control value for the feed member 40 corresponding to the number of stacked sheets may be prepared in advance in the control table.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper sheet processing apparatus, comprising:

a processing tray for receiving and stacking a plurality of paper sheets;

a feed member that is rotatably arranged above the processing tray to face the processing tray and includes a paddle elastically deformed by being pressed against the paper sheets during rotation to scrape the paper sheets stacked on the processing tray toward an alignment surface by the paddle;

a drive component that rotates the feed member;

a detector arranged between the feed member and the alignment surface and that detects a leading end of the paper sheet being fed toward the alignment surface by the paddle;

a controller for controlling the drive component based on a detection result of the detector during a period from detecting the leading end of the paper sheet to separating from the paper sheet, and for controlling the rotation of the feed member so that the leading end of the paper sheet scraped by the paddle is aligned with the alignment surface; and a memory storing an optimal control value for the feed member based on a thickness of the paper sheet detected by the detector, wherein the controller reads out the optimal control value from the memory based on the detection result and controls the drive component according to the control value.

2. The paper sheet processing apparatus according to claim 1, further comprising:

a stapler for binding the leading ends of the paper sheets aligned on the alignment surface.

3. The paper sheet processing apparatus according to claim 1, further comprising:

a standby tray arranged above the processing tray, the standby tray temporarily reserves the paper sheets fed to the processing tray, and drops the paper sheets onto the processing tray.

4. The paper sheet processing apparatus according to claim 1, wherein the controller controls the drive component to decelerate a rotational speed of the feed member after the detector detects the leading end of the paper sheet.

5. The paper sheet processing apparatus according to claim 4, wherein the controller controls a timing at which the drive component decelerates the rotational speed of the feed member.

6. The paper sheet processing apparatus according to claim 1, wherein the detector is rotatably arranged above the processing tray to face the processing tray and includes a contactor that has a contact end at the leading end of the rotation, which contacts an upper surface of the paper sheet fed between the contactor and the processing tray by its own weight and rotates by the thickness of the paper sheet if the leading end of the paper sheet passes the contact end, and an angle sensor that detects a rotation angle of the contactor.

7. The paper sheet processing apparatus according to claim 1, wherein the feed member further includes an auxiliary paddle different from the paddle, which is pressed against the paper sheet during the rotation and elastically deformed to scrape the leading end of the paper sheet toward the alignment surface.

8. The paper sheet processing apparatus according to claim 1, wherein the memory stores the optimal control value according to the number of paper sheets stacked on the processing tray, and depending on how many paper sheets stacked on the processing tray are the paper sheets whose leading ends are detected by the detector, the controller reads out the optimal control value from the memory and controls the drive component according to the control value.

9. A paper sheet processing method, comprising:

receiving and stacking a plurality of paper sheets on a processing tray;

rotating a feed member including a paddle to scrape the paper sheets stacked on the processing tray toward an alignment surface by the paddle elastically deformed by being pressed against the paper sheets during rotation;

detecting a leading end of the paper sheet being fed toward the alignment surface by the paddle;

controlling the rotating based on a detection result during a period from detecting the leading end of the paper sheet to separating from the paper sheet, and controlling the rotating so that the leading end of the paper sheet scraped by the paddle is aligned with the alignment surface; and storing an optimal control value for the feed member based on a detected thickness of the paper sheet; and reading out the optimal control value from a memory based on the detection result, wherein the controlling the rotating comprises controlling the rotating based on the control value.

10. The paper sheet processing method according to claim 9, further comprising:

binding the leading ends of the paper sheets aligned on the alignment surface.

11. The paper sheet processing method according to claim 9, further comprising:

controlling the rotating to decelerate a rotational speed of the feed member after detecting the leading end of the paper sheet.

12. An image forming apparatus, comprising:

an image forming component; and a paper sheet processing apparatus, comprising:

a processing tray for receiving and stacking a plurality of paper sheets;

a feed member that is rotatably arranged above the processing tray to face the processing tray and includes a paddle elastically deformed by being pressed against the paper sheets during rotation to scrape the paper sheets stacked on the processing tray toward an alignment surface by the paddle;

a drive component that rotates the feed member;

a detector arranged between the feed member and the alignment surface and that detects a leading end of the paper sheet being fed toward the alignment surface by the paddle;

a controller for controlling the drive component based on a detection result of the detector during a period from detecting the leading end of the paper sheet to separating from the paper sheet, and for controlling the rotation of the feed member so that the leading end of the paper sheet scraped by the paddle is aligned with the alignment surface; and a memory storing an optimal control value for the feed member based on a thickness of the paper sheet detected by the detector, wherein the controller reads out the optimal control value from the memory based on the detection result and controls the drive component according to the control value.

13. The image forming apparatus according to claim 12, further comprising:

a stapler for binding the leading ends of the paper sheets aligned on the alignment surface.

14. The image forming apparatus according to claim 12, further comprising:

a standby tray arranged above the processing tray, the standby tray temporarily reserves the paper sheets fed to the processing tray, and drops the paper sheets onto the processing tray.

15. The image forming apparatus according to claim 12, wherein the controller controls the drive component to decelerate a rotational speed of the feed member after the detector detects the leading end of the paper sheet.

16. The image forming apparatus according to claim 12, wherein the detector is rotatably arranged above the processing tray to face the processing tray and includes a contactor that has a contact end at the leading end of the rotation, which contacts an upper surface of the paper sheet fed between the contactor and the processing tray by its own weight and rotates by the thickness of the paper sheet if the leading end of the paper sheet passes the contact end, and an angle sensor that detects a rotation angle of the contactor.

* * * * *